US008267620B2

(12) United States Patent
Wood, II et al.

(10) Patent No.: US 8,267,620 B2
(45) Date of Patent: Sep. 18, 2012

(54) ROTATABLE BOAT LIFT WITH SLIDING PADS

(75) Inventors: Donald M. Wood, II, Palm City, FL (US); Ryan Hyde, Palm City, FL (US)

(73) Assignee: Hi-Tide Sales, Inc., Fort Pierce, FL (US)

( * ) Notice: Subject to any disclaimer, the term of this patent is extended or adjusted under 35 U.S.C. 154(b) by 364 days.

(21) Appl. No.: 12/587,912

(22) Filed: Oct. 15, 2009

(65) Prior Publication Data

US 2010/0104365 A1 Apr. 29, 2010

Related U.S. Application Data

(60) Provisional application No. 61/197,285, filed on Oct. 24, 2008, provisional application No. 61/215,731, filed on May 8, 2009.

(51) Int. Cl.
*B63C 3/12* (2006.01)

(52) U.S. Cl. ..... 405/3; 114/44; 114/230.23; 254/264

(58) Field of Classification Search ..... 405/3; 114/44, 114/230.16, 230.23; 254/334, 264
See application file for complete search history.

(56) References Cited

U.S. PATENT DOCUMENTS

| | | | |
|---|---|---|---|
| 1,695,674 | A | 12/1928 | Wilson |
| 2,808,016 | A | 10/1957 | Jarnot |
| 2,979,014 | A | 4/1961 | Yordi |
| 2,990,803 | A | 7/1961 | Henderson |
| 3,060,885 | A | 10/1962 | Nolf |
| 3,177,839 | A | 4/1965 | Nolf |
| 3,191,389 | A | 6/1965 | Poe |
| 3,265,024 | A | 8/1966 | Kramlich |
| 3,504,502 | A | 4/1970 | Blount |
| 3,675,258 | A | 7/1972 | Osmundson |
| 3,778,855 | A | 12/1973 | Kariagin et al. |
| 3,791,229 | A | 2/1974 | Litezki |
| 3,830,452 | A | 8/1974 | Seay |
| 4,185,514 | A | 1/1980 | Edwards |
| 4,337,868 | A | 7/1982 | Gattu |
| 4,346,728 | A | 8/1982 | Sulzer |
| 4,589,800 | A | 5/1986 | Nasby, Jr. |
| 4,641,996 | A | 2/1987 | Seal |
| 4,686,920 | A | 8/1987 | Thomas |
| 4,954,011 | A | 9/1990 | Stenson |
| 4,979,603 | A | 12/1990 | Wheatland |
| 4,983,067 | A | 1/1991 | Montgomery |
| 5,014,638 | A | 5/1991 | Ilves et al. |
| 5,020,463 | A | 6/1991 | Franklin et al. |

(Continued)

FOREIGN PATENT DOCUMENTS

| | | |
|---|---|---|
| GB | 588394 | 6/1947 |

*Primary Examiner* — Tara Mayo-Pinnock
(74) *Attorney, Agent, or Firm* — Sperry, Zoda & Kane

(57) ABSTRACT

A boat lift with a rotatable head attached to a bracket securable with respect to environmental structure such as a pier which to be capable of lifting a watercraft from the water and while rotating thereof to a position above an adjacent area such a dock area. The lift includes a rotating head assembly having a mounting fin extendable into the interior of a vertically reciprocating mast. A watercraft supporting cradle is secured to the mast to be movable therewith and includes vessel support members for facilitating retaining of a watercraft thereupon. Vertical movement between the mounting fin and the reciprocating mast is facilitated by sliding wear pads positioned therebetween.

20 Claims, 6 Drawing Sheets

U.S. PATENT DOCUMENTS 5,051,027 A 9/1991 Horton
5,063,316 A 11/1991 Ming
5,090,842 A 2/1992 Montgomery
5,140,923 A 8/1992 Wood
5,143,182 A 9/1992 Basta
5,211,124 A 5/1993 Reiser
5,245,940 A 9/1993 Rockwood
5,261,347 A 11/1993 Mansfield
5,287,821 A 2/1994 Godbersen
5,301,628 A 4/1994 Daskalides
5,345,834 A 9/1994 Hayashi
5,390,616 A 2/1995 Roth
5,590,978 A 1/1997 Urbank
5,593,247 A 1/1997 Endes et al.
5,687,663 A 11/1997 Wahlstrand
5,701,834 A 12/1997 Lyons
D390,188 S 2/1998 Norfolk et al.
5,749,313 A 5/1998 Shackelford, Jr.
5,755,529 A 5/1998 Follett
5,769,568 A 6/1998 Parkins et al.
5,772,360 A 6/1998 Wood, II
5,803,003 A 9/1998 Vickers
5,839,320 A 11/1998 Komachi
5,915,877 A 6/1999 Sargent et al.
5,934,826 A 8/1999 Mansfield
5,947,639 A 9/1999 Bishop et al.
5,957,623 A 9/1999 Sargent et al.
5,970,813 A 10/1999 Parkins et al.
5,988,941 A 11/1999 Sargent et al.
6,006,687 A 12/1999 Hillman et al.
6,021,692 A 2/2000 Norfolk et al.
6,027,303 A 2/2000 Voegeli
6,032,601 A 3/2000 Gates
6,033,148 A 3/2000 Norfolk et al.
6,044,723 A 4/2000 Eda et al.
6,059,256 A 5/2000 Matthews
6,067,923 A 5/2000 Ratlieff, Jr.
6,076,478 A 6/2000 Siegmann
6,122,994 A 9/2000 Norfolk et al.
6,174,106 B1 1/2001 Bishop et al.
6,230,639 B1 5/2001 McLaughlin et al.
6,257,159 B1 7/2001 Siegmann
6,257,167 B1 7/2001 Joaquim
6,305,236 B1 10/2001 Sturdevant
6,397,691 B1 6/2002 Greene
6,408,776 B1 6/2002 McLaughlin et al.
6,408,778 B1 6/2002 Wood, II
6,435,768 B1 8/2002 Mansfield
6,457,904 B2 10/2002 Bishop et al.
6,484,655 B1 11/2002 Gibson
6,494,155 B2 12/2002 Gibson
6,543,375 B1 4/2003 Sargent et al.
6,547,485 B2 4/2003 Elson
6,584,922 B1 7/2003 Fritz et al.
6,591,770 B1 7/2003 Blackmore
6,640,736 B1 11/2003 McLaughlin et al.
6,644,630 B1 11/2003 Lorenz
6,695,533 B1 2/2004 Bulmann
6,709,197 B1 3/2004 Sargent et al.
6,767,004 B1 7/2004 Davis
6,769,839 B2 8/2004 Elson
6,786,170 B2 9/2004 Trowbridge
6,846,129 B1 1/2005 Edson
6,883,784 B1 4/2005 Sloneker et al.
6,904,857 B1 6/2005 Holden
6,935,807 B2 8/2005 Becker
6,976,806 B2 12/2005 Edson
6,979,149 B1 12/2005 Thompson
7,001,104 B2 2/2006 Edson
7,066,683 B2 6/2006 Way
7,080,719 B2 7/2006 Arnold et al.
7,090,055 B1 8/2006 McLaughlin et al.
7,090,431 B2 8/2006 Cosgrove et al.
7,104,492 B1 9/2006 Massell et al.
7,117,805 B2 10/2006 Shackelford et al.
7,128,307 B2 10/2006 Dow
7,182,034 B2 2/2007 Brine
7,207,746 B1 4/2007 Legun
7,213,526 B1 * 5/2007 Hamilton ..... 114/44
7,226,041 B2 6/2007 Ledford
7,237,788 B1 7/2007 Norbits
7,246,970 B2 7/2007 Hey
7,293,521 B1 11/2007 Johns, Jr. et al.
7,325,503 B1 2/2008 Vaughn et al.
7,338,231 B2 3/2008 Masters
7,377,485 B2 5/2008 Davis
7,383,781 B1 6/2008 Griffin
7,407,150 B1 8/2008 Bellantoni
7,413,378 B2 8/2008 Way
7,478,795 B2 1/2009 Grapes et al.
7,481,175 B2 1/2009 Dickman
7,503,274 B2 3/2009 Weed et al.
7,509,916 B1 3/2009 Nelson, Jr.
7,527,243 B2 5/2009 Blasek
7,534,069 B1 5/2009 Stanley
7,543,800 B2 6/2009 Grapes et al.
7,547,159 B1 6/2009 Warters

* cited by examiner

ROTATABLE BOAT LIFT WITH SLIDING PADS

The present utility application hereby formally claims priority of U.S. Provisional Patent Application No. 61/197,285 filed Oct. 24, 2008 on a "Rotatable Boat Lift With Sliding Pads" filed by Ryan Hyde, said referenced provisional patent application being formally incorporated by reference as an integral part of the present application.

The present utility application also hereby formally claims priority of U.S. Provisional Patent Application No. 61/215,731 filed May 8, 2009 on "Rotatable Boat Lift With Sliding Pads" filed by Donald M. Wood, II, said referenced provisional patent application being hereby formally incorporated by reference as an integral part of the present application.

BACKGROUND OF THE INVENTION

1. Field of the Invention

The present invention deals with the general field of boat lifts and most particularly with those boat lifts designed to lift a watercraft from a water environment to a position immediately thereabove and then being capable of lateral rotation such that the watercraft can be stored or positioned for storage or other reason above an adjacent land or dock area.

2. Description of the Prior Art

Numerous devices have been utilized for boat lifts for facilitating removal or replacement of a boat with respect to a water environment adjacent to a dock or pier such as shown in U.S. Pat. No. 1,695,674 patented Dec. 18, 1928 on a "Traveler Slide For Sail Attachments"; and U.S. Pat. No. 2,808,016 patented Oct. 1, 1957 to F. R. Jarnot on a "Boat Mooring Device"; and U.S. Pat. No. 2,868,031 patented Jan. 13, 1959 to M. T. Schumb on a "Speed Reducer With Detachable Drive Motor"; and U.S. Pat. No. 2,979,014 patented Apr. 11, 1961 to A. H. Yordi on a "Boat Mooring Device"; and U.S. Pat. No. 2,990,803 patented Jul. 4, 1061 to H. P. Henderson on a "Boat Mooring Apparatus"; and U.S. Pat. No. 3,060,885 patented Oct. 30, 1962 to G. H. Nolf on a "Docking Bar For Boats"; and U.S. Pat. No. 3,177,839 patented to G. H. Nolf on Apr. 13, 1965 on a "Boat-Docking Apparatus With Pressure-Responsive Grapple"; and U.S. Pat. No. 3,191,389 patented Jun. 29, 1965 to J. B. Poe on a "Boat Lift"; and U.S. Pat. No. 3,265,024 patented Aug. 9, 1966 to C. W. Kramlich on a "Boat Lift"; and U.S. Pat. No. 3,504,502 patented Apr. 7, 1970 to L. H. Blount on a "Lift Dock For A Water Borne Vessel"; and U.S. Pat. No. 3,675,258 patented Jul. 11, 1972 to B. M. Osmundson on a "Boat Hoist"; and U.S. Pat. No. 3,791,855 patented Dec. 18, 1973 to N. Kariagin et al and assigned to Whittaker Corporation on a "Telescoping Gravity Davit"; and U.S. Pat. No. 3,791,229 patented Feb. 12, 1974 to H. Litezki and assigned to Schiess Aktiengesellschaft on a "Lifting Device For Lifting And Lowering Heavy Loads"; and U.S. Pat. No. 3,830,452 patented Aug. 20, 1974 to S. D. Seay and assigned to Kaman Aerospace Corporation on a "Monorail Traverse System"; and U.S. Pat. No. 4,185,514 patented Jan. 29, 1980 to E. D. Edwards on an "Adapter For Motor-Speed Reducer Sets"; and U.S. Pat. No. 4,337,868 patented Jul. 6, 1982 to N. Gattu and assigned to Harnischfeger Corporation on a "Telescopic Crane Boom Having Rotatable Extend/Retract Screws"; and U.S. Pat. No. 4,346,728 patented Aug. 31, 1982 to H. E. Sulzer and assigned to Anchor/Darling Industries, Inc. on an "Automated Dual Mode Valve Actuator"; and U.S. Pat. No. 4,589,800 patented May 20, 1986 to C. L. Nasby, Jr. on a "Dock Structure And Method And Apparatus For Raising And Lowering Same"; and U.S. Pat. No. 4,641,996 patented Feb. 10, 1987 to M. Seal on "Side Loading Boat Lifts"; and U.S. Pat. No. 4,686,920 patented Aug. 18, 1987 to J. L. Thomas on "Cradle Type Boat Lifts"; and U.S. Pat. No. 4,954,011 patented Sep. 4, 1990 to S. H. Stenson on a "Powered Method And Apparatus For Lifting A Boat"; and U.S. Pat. No. 4,979,603 patented Dec. 25, 1990 to G. Wheatland and assigned to 501 Manaras Auto Doors, Inc. on a "Load Sensing Gearbox"; and U.S. Pat. No. 4,983,067 patented Jan. 8, 1991 to D. M. Montgomery on a "Boat Lift Apparatus"; and U.S. Pat. No. 5,014,638 patented May 14, 1991 to J. E. Ilves et al on a "Mooring Construction For A Boat"; and U.S. Pat. No. 5,020,463 patented Jun. 4, 1991 to R. E. Franklin et al on an "Arrangement For Raising Or Lowering Boats Or The Like"; and U.S. Pat. No. 5,051,027 patented Sep. 24, 1991 to G. F. Horton on a "Boat Lift"; and U.S. Pat. No. 5,063,316 patented to C. E-Ming on Nov. 5, 1991 on an "Automatic Door Protective Reversing Switch With Worm Gear"; and U.S. Pat. No. 5,090,842 patented Feb. 25, 1992 to D. M. Montgomery on a "Boat Lift Apparatus And System"; and U.S. Pat. No. 5,140,923 patented Aug. 25, 1992 to K. L. Wood on a "Raising And Lowering Device"; and U.S. Pat. No. 5,143,182 patented Sep. 1, 1992 to S. T. Basta on a "Low-Profile Watercraft Lift"; and U.S. Pat. No. 5,211,124 patented May 18, 1993 to J. N. Reiser and assigned to Triton Corporation on a "Winch Construction For Boat Lift"; and U.S. Pat. No. 5,245,940 patented Sep. 21, 1993 to J. C. Rockwood on a "Load Lifting Device"; and U.S. Pat. No. 5,261,347 patented Nov. 16, 1993 to P. W. Mansfield on a "Sailboat Davit"; and U.S. Pat. No. 5,287,821 patented Feb. 22, 1994 to B. L. Godbersen on an "Electric Drive Mechanism For Boat Hoist Winch"; and U.S. Pat. No. 5,301,628 patented Apr. 12, 1994 to G. B. Daskalides on a "Boat Docking Post"; and U.S. Pat. No. 5,345,834 patented Sep. 13, 1994 to K. Hayashi and assigned to Kabushiki Kaisha Sankyo Seiki Seisakusho on a "Velocity-Reduced Drive System"; and U.S. Pat. No. 5,390,616 patented Feb. 21, 1995 to H. Roth on a "Dock Mounted Small Boat Lifting System"; and U.S. Pat. No. 5,590,978 patented Jan. 7, 1997 to V. Urbank on an "Elevator Construction for The Launching And Recovery Of Personal Watercraft"; and U.S. Pat. No. 5,593,247 patented Jan. 14, 1997 to J. A. Endres et al and assigned to Endcor Inc. on a "Programming Boat Lift Control System"; and U.S. Pat. No. 5,687,663 patented Nov. 18, 1997 to N. D. Wahlstrand on a "Boat Lift Transport Apparatus"; and U.S. Pat. No. 5,701,834 patented Dec. 30, 1997 to R. A. Lyons on a "Lift For Watercraft"; and U.S. Design Pat. No. D390,188 patented Feb. 3, 1998 to L. P. Norfolk et al and assigned to Norfolk Fabrication, Inc. on a "Boat Lift Motor And Gear Housing"; and U.S. Pat. No. 5,749,313 patented to F. H. Shackelford, Jr. on May 12, 1998 on a "Watercraft Lift"; and U.S. Pat. No. 5,755,529 patented May 26, 1998 to r. R. B. Follett on a "Boat Lift"; and U.S. Pat. No. 5,769,568 patented Jun. 23, 1998 to D. G. Parkins et al and assigned to ABL Boat Lifts on an "Adaptable Boat Lift"; and U.S. Pat. No. 5,772,360 patented Jun. 30, 1998 to D. M. Wood, II on a "Topless Watercraft Lifting Apparatus With A Differential Gearing System"; and U.S. Pat. No. 5,803,003 patented Sep. 8, 1998 to R. V. Vickers and assigned to The Louis Berkman Company on a "Rotary Boat Lift"; and U.S. Pat. No. 5,839,320 patented Nov. 24, 1998 to H. Komachi and assigned to Harada Industry Co., Ltd. on an "Actuator"; and U.S. Pat. No. 5,915,877 patented Jun. 29, 1999 to C. L. Sargent et al and assigned to Quality Boat Lift, Inc. on a "Positive Drive Boat Lift"; and U.S. Pat. No. 5,934,826 patented Aug. 10, 1999 to P. W. Mansfield on a "Boat Lift Apparatus"; and U.S. Pat. No. 5,947,639 patented Sep. 7, 1999 to R. B. Bishop et al on a "Boat Lift Apparatus"; and U.S. Pat. No. 5,957,623 patented Sep. 28, 1999 to C. L. Sargent et al and assigned to Quality Boat Lifts, Inc. on an "Electrically Insulated Positive Drive Boat Lift"; and U.S. Pat. No. 5,970,813 patented Oct. 26, 1999 to D. G. Parkins et al and assigned to ABL Boat Lifts on a "Drive System"; and U.S. Pat. No. 5,988,941 patented Nov. 23, 1999 to C. L. Sargent et al and assigned to Quality Boat Lifts, Inc. on a "Boat Lift Cable Lock Apparatus"; and U.S. Pat. No. 6,006,687 patented Dec. 28, 1999 to J. M. Hillman et al and assigned to Marine Floats, Inc. on a "Modular Floating Boat Lift"; and U.S. Pat. No. 6,021,692 patented Feb. 8, 2000 to L. P. Norfolk et al and assigned to Norfolk Fabrication, Inc. on a "Housing For A Boat Lift Motor Pulley And Gear Drive"; and U.S. Pat. No. 6,027,303 patented Feb. 22, 2000 to R. C. Voegeli on a "Non-Counterweighted Lift Truck And Method Of Operation"; and U.S. Pat. No. 6,032,601 patented Mar. 7, 2000 to C. D. Gates on a "Combination Boat Lift And Dock"; and U.S. Pat. No. 6,033,148 patented Mar. 7, 2000 to L. P. Norfolk et al and assigned to Norfolk Fabrication, Inc. on a "Housing For A Boat Lift Motor, Pulley And Gear Drive"; and U.S. Pat. No. 6,044,723 patented Apr. 4, 2000 to H. Eda et al and assigned to NSK Ltd. on an "Electric Power Assisting Steering Apparatus"; and U.S. Pat. No. 6,059,256 patented May 9, 2000 to M. R. Matthews on a "Bulkhead Forming System"; and U.S. Pat. No. 6,067,923 patented May 30, 2000 to W. D. Ratlieff, Jr. on a "Turbulent stabilizing Venturi System"; and U.S. Pat. No. 6,076,478 patented Jun. 20, 2000 to G. Siegmann on an "Apparatus For Raising And Lowering Boats"; and U.S. Pat. No. 6,122,994 patented Sep. 26, 2000 to L. P. Norfolk et al and assigned to Norfolk Fabrication, Inc. on a "Housing For A Boat Lift Motor, Pulley And Gear Drive"; and U.S. Pat. No. 6,174,106 patented Jan. 16, 2001 to R. B. Bishop et al on a "Boat Lift Apparatus"; and U.S. Pat. No. 6,230,639 patented May 15, 2001 to S. M. McLaughlin et al and assigned to Quality Boat Lifts, Inc. on a "Single Motor Boat Lift Having Horizontally And Longitudinally Driven. Cables"; and U.S. Pat. No. 6,257,159 patented Jul. 10, 2001 to G. Siegmann on an "Apparatus For Raising And Lowering Boats In Water"; and U.S. Pat. No. 6,257,167 patented Jul. 10, 2001 to A. T. Joaquim on a "Combination Boat Trailer And Lift"; and U.S. Pat. No. 6,305,236 patented Oct. 23, 2001 to G. A. Sturdevant and assigned to George A. Sturdevant, Inc. on a "Worm Gear Torque Apparatus"; and U.S. Pat. No. 6,397,691 patented Jun. 4, 2002 to R. R. Greene and assigned to Hi-Tide Sales, Inc. on a "Double Reduction Gear Drive Means"; and U.S. Pat. No. 6,408,776 patented Jun. 25, 2002 to S. M. McLaughlin et al and assigned to Quality Boat Lifts, Inc. on a "Synchronously Driven, Multiple Cable Boat Lift"; and U.S. Pat. No. 6,408,778 patented Jun. 25, 2002 to D. M. Wood, II and assigned to Hi-Tide Sales, Inc. on a "Watercraft Retriever Lift"; and U.S. Pat. No. 6,435,768 patented Aug. 20, 2002 to P. W. Mansfield on a "Boat Lift Apparatus"; and U.S. Pat. No. 6,457,904 patented Oct. 1, 2002 to R. B. Bishop et al on a "Boat Lift Apparatus"; and U.S. Pat. No. 6,484,655 patented Nov. 26, 2002 to R. P. Gibson on a "Synchronous Cable Transmission System For Boat Lifts"; and U.S. Pat. No. 6,494,155 patented Dec. 17, 2002 to R. P. Gibson on a "Three Piling Boat Lift"; and U.S. Pat. No. 6,543,375 patented Apr. 8, 2003 to C. L. Sargent et al and assigned to Quality Boat Lifts, Inc. on a "Solar Powered Boat Lift"; and U.S. Pat. No. 6,547,485 patented Apr. 15, 2003 to T. A. Elson and assigned to Hydrohoist International, Inc. on a "Stern-On Mooring Boat Lift"; and U.S. Pat. No. 6,584,922 patented Jul. 1, 2003 to E. L. Fritz et al on a "Portable Boat Lift"; and U.S. Pat. No. 6,591,770 patented Jul. 15, 2003 to W. R. Blackmore and assigned to St. Croix Marine Products, Inc. on a "Boating Lift"; and U.S. Pat. No. 6,640,736 patented Nov. 4, 2003 to S. M. McLaughlin et al and assigned to Quality Boat Lifts, Inc. on a "Synchronously Driven, Multiple Cable Boat Lift"; and U.S. Pat. No. 6,644,630 patented Nov. 11, 2003 to D. H. Lorenz and assigned to Lorenz Manufacturing Company on a "Brake Mechanism For Winch Assembly"; and U.S. Pat. No. 6,695,533 patented Feb. 24, 2004 to S. P. Bulmann on a "Boat Hoist Hydraulic Lift Device"; and U.S. Pat. No. 6,709,197 patented to C. L. Sargent et al on Mar. 23, 2004 and assigned to Quality Boat Lifts, Inc. on a "Large Capacity Boat Lift"; and U.S. Pat. No. 6,767,004 patented Jul. 27, 2004 to B. Davis and assigned to Commander Products LLC on "Replacement Motorized Drive Unit For Boat Lifts"; and U.S. Pat. No. 6,769,839 patented Aug. 3, 2004 to T. A. Elson and assigned to HydroHoist International, Inc. on a "Stern-On Mooring Boat Lift"; and U.S. Pat. No. 6,786,170 patented Sep. 7, 2004 to D. L. Trowbridge on a "Boat Lifting Device"; and U.S. Pat. No. 6,846,129 patented Jan. 25, 2005 to H. W. Edson on a "Boatlift And Movable Canopy Assembly"; and U.S. Pat. No. 6,883,784 patented Apr. 26, 2005 to W. L. Sloneker et al on a "Boat Lift Using One-Way Clutch"; and U.S. Pat. No. 6,904,857 patented Jun. 14, 2005 to G. A. Holden on a "Boat Lift Securing Device"; and U.S. Pat. No. 6,935,807 patented Aug. 30, 2005 to G. F. Becker on a "Device For Maintaining Tension On Lift Cables"; and U.S. Pat. No. 6,976,806 patented Dec. 20, 2005 to H. W. Edson on a "Boatlift And Movable Canopy Assembly"; and U.S. Pat. No. 6,979,149 patented Dec. 27, 2005 to K. R. Thompson on a "Vessel Transfer System And Associated Methods"; and U.S. Pat. No. 7,001,104 patented Feb. 21, 2006 to H. W. Edson on a "Boatlift And Movable Canopy Assembly"; and U.S. Pat. No. 7,066,683 patented Jun. 27, 2006 to R. L. Way on a "Hydraulically Operated Low Profile Boat Lift Utilizing At least Two Pilings"; and U.S. Pat. No. 7,080,719 patented Jul. 25, 2006 to J. E. Arnold et al and assigned to Reell Precision Manufacturing Corporation on a "Wrap Spring Brake"; and U.S. Pat. No. 7,090,055 patented Aug. 15, 2006 to S. M. McLaughlin et al and assigned to Quality Boat Lifts, Inc. on a "Boat Lift Brake Apparatus"; and U.S. Pat. No. 7,090,431 patented Aug. 15, 2006 to P. J. Cosgrove et al on a "Marine Vessel Lifting System With Variable Level Detection"; and U.S. Pat. No. 7,104,492 patented Sep. 12, 2006 to G. Massell et al and assigned to Deco Power Lift, Inc. on a "Cable Winder Guide"; and U.S. Pat. No. 7,117,805 patented Oct. 10, 2006 to F. H. Shackelford, Jr. and assigned to Tide Tamer Industries, Inc. on a "Boat Lift"; and U.S. Pat. No. 7,128,307 patented Oct. 31, 2006 to J. E. Dow and assigned to WW Patterson Company on a "Manual Marine Winch With Compound Handle"; and U.S. Pat. No. 7,182,034 patented Feb. 27, 2007 to W. H. Brine on an "Offshore Floating Dock"; and U.S. Pat. No. 7,207,746 patented Apr. 24, 2007 to D. Legun on a "Remote Boat Lift Switch"; and U.S. Pat. No. 7,226,041 patented Jun. 5, 2007 to M. P. Ledford on a "Winch Assembly For A Lift Structure Supportive Of A Recreational Boat And Related Watercraft"; and U.S. Pat. No. 7,237,788 patented Jul. 3, 2007 to G. T. Norbits on a "Boat Loading System"; and U.S. Pat. No. 7,246,970 patented Jul. 24, 2007 to K. E. Hey and assigned to Sunstream Corporation on a "Shallow Water Watercraft Lift"; and U.S. Pat. No. 7,293,521 patented Nov. 13, 2007 to C. E. Johns, Jr. et al and assigned to Sealift, Inc. on an "Hydraulic Transom Lift"; and U.S. Pat. No. 7,325,503 patented Feb. 5, 2008 to M. D. Vaughn and assigned to Hydro Hoist International, Inc. on a "Watercraft Lift"; and U.S. Pat. No. 7,338,231 patented Mar. 4, 2008 to K. G. Masters and assigned to Multi Automated Products on a "Boat Hoist"; and U.S. Pat. No. 7,377,485 patented May 27, 2008 to E. W. Davis and assigned to Commander Products LLC on a "Replacement Motorized Drive Unit For Boat Lifts"; and U.S. Pat. No. 7,383,781 patented Jun. 10, 2008 to W. B. Griffin and assigned to Tide Tamer Industries, Inc. on "Drive Units, Drive Systems and Boat Lift Systems Including The Same"; and U.S. Pat. No. 7,407,150 patented Aug. 5, 2008 to J. F. Bellantoni on a "Self-Stabilizing Suspension And Hoisting System"; and U.S. Pat. No. 7,413,378 patented Aug. 19, 2008 to R. L. Way on a "Boat Lift"; and U.S. Pat. No. 7,478,795 patented Jan. 20, 2009 to D. B. Grapes et al and assigned to W.W. Patterson Company on a "Marine Winch With Winch-Line Engaging Roller"; and U.S. Pat. No. 7,481,175 patented Jan. 27, 2009 to J. Dickman on a "Floating Dock"; and U.S. Pat. No. 7,503,274 patented Mar. 17, 2009 to R. T. Weed et al and assigned to Ronald T. Weed, Jr. on a "Floating Lift For Watercraft"; and U.S. Pat. No. 7,509,916 patented Mar. 31, 2009 to B. Nelson, Jr. on a "Floating Dock With Integrated Boat Lift"; and U.S. Pat. No. 7,527,243 patented May 5, 2009 to F. Blasek and assigned to Greifzug Hebezeugbau GmbH on a "Platform Lifting Mechanism Provided With A Driving Pulley And Corresponding Driving System"; and U.S. Pat. No. 7,534,069 patented May 19, 2009 to J. C. Stanley on a "Programmable Boatlift System With Boat Position Sensor"; and U.S. Pat. No. 7,543,800 patented Jun. 9, 2009 to D. B. Grapes et al and assigned to W. W. Patterson Company on a "Single Stack Manual Marine Winch"; and U.S. Pat. No. 7,547,159 patented Jun. 16, 2009 to H. D. Warters on a "Cradle Boat Lift Storm Protection System"; and British Patent Specification No. 588.394 of Jun. 19, 1947 to J. M. Lamb et al on "Improvements In Or Relating To Curtain Runners".

SUMMARY OF THE INVENTION

The present invention provides a uniquely configured rotatable boat lift which includes sliding pads for maintaining a mast vertically movable with respect to the rotatable head. The lift includes a mounting bracket fixedly securable to environmental structure such as a piling or pier and preferably the mounting bracket will define a pivot cup therein. A rotating head is pivotally secured with respect to the mounting bracket to be movable preferably through an angle of at least 90 degrees. The rotating head extends outwardly from the mounting bracket. The rotating head will include a fin which is generally planar and extends vertically which extends outwardly from the rotating head. A sliding pad assembly is attached to the pin and extends outwardly therefrom. The sliding pad assembly preferably includes at least one first wear pad strip preferably of thermoplastic material attached to the fin and extending outwardly therefrom. Similarly the sliding pad assembly preferably also includes a second wear pad strip preferably of thermoplastic material attached to the fin of the rotating head such that it extends outwardly therefrom at a position spatially disposed from the first wear pad strip.

The rotating head preferably further includes a pivoting pin extending preferably downwardly therefrom which is adapted to be positionable within the pivot cup defined in the mounting bracket to facilitate pivotal movement of the rotating head with respect to the mounting bracket. Furthermore the rotating head will preferably also include a guide plate which extends outwardly from the fin in an orientation laterally with respect to the mast slot whenever the sliding pad assembly is positioned within the mast chamber. This guide plate is wider than the width of the mast slot to limit the depth of penetration of the rotating head into the mass chamber. The guide plate is preferably positioned on the fin of the rotating head between the sliding pad and the pivot pin.

The rotatable boat lift further includes a mast which is preferably hollow and extends generally vertically in a longitudinal direction. The mast preferably includes a plurality of interior walls which define a mast chamber therewithin which preferably will have a cross-sectional shape which is generally rectangular. One of the interior walls of the mast will define a mast slot running generally vertically thereal-ong. This mast slot will preferably be in fluid flow communication with respect to the mast chamber within the mast. The fin of the rotating head is preferably positionable extending through the mast slot into the mast chamber of the mast with the sliding pad assembly positioned in gliding abutment with respect to the interior walls thereof and movable with respect thereto for the purpose of facilitating sliding engagement and movement of the mast with respect to the rotating head. The first wear strip and the second wear strip will preferably be extending outwardly from the rotating head into engaging movable abutment with respect to the interior walls of the mast within the mast chamber thereof to facilitate movement of the mast with respect to the rotating head. The guide plate will be positioned on the rotating head extending laterally with respect to the mast slot responsive to the sliding pad assembly being positioned within the mast chamber. The guide plate will be preferably wider than the width of the mass slot to limit the depth of penetration of the rotating head into the mast chamber. The guide plate is preferably positioned on the fin of the rotating head between the sliding pad and the pivot pin.

The rotatable boat lift further includes a cradle secured to the mast which is movable therewith. This cradle is adapted to be positionable beneath the watercraft to facilitate supporting and retaining thereof with respect to the mast to facilitate urging controlled movement thereof along with the cradle and the mast. The cradle further will include a vessel support secured thereto and extend outwardly therefrom to facilitate support and retaining of a watercraft thereupon. This vessel support will preferably be constructed having two vessel support members spatially disposed with one another to facilitate direct abutment and support of the watercraft thereabove. The rotatable boat lift will also preferably include a winch attached with respect to the rotating head. The winch includes preferably a cable attached with respect to the mast to provide powered movement of the mast with respect to the rotating head to facilitate powered movement of the watercraft supported by the cradle responsive to operation of the winch.

The rotating boat lift will further include a pulley assembly mounted with respect to the mast and with respect to the rotating head which is adapted to receive a cable wound peripherally therearound to facilitate powering movement of the mast with respect to the rotating head. This pulley assembly will preferably include an upper pulley rotatably mounted with respect to the rotating head and the lower pulley rotatably mounted with respect to the mast. The cable of the winch will preferably extend outwardly from the winch and around the upper pulley and then downwardly around the lower pulley and then upwardly for direct attachment to the rotating head to facilitate powered movement of the mast with respect to the rotating head in the generally vertically extending direction.

In a preferred configuration of the present invention the sliding pad assembly will include two first wear pad strips spatially disposed vertically from on another and two second wear pad strips spatially disposed also vertically from one another and positioned spatially disposed from the first wear pad strips.

The configuration of the pivot pin of the present invention may preferably include a first pivot pin and a second pivot pin spatially disposed from one another. With this configuration the pivot cup will also include a first pivot cup adapted to receive the first pivot pin extending therein and a second pivot cup adapted to receive the second pivot pin extending thereinto. In this manner pivotal movement of the rotating head with respect to the mounting bracket is further facilitated. In a further preferred embodiment the first and second pivot pin will be vertically in registration with one another and the first and second pivot cups will be vertically in registration with one another to facilitate pivotal movement between the rotating head and the mounting bracket.

In a preferred configuration of the present invention the interior walls are four in number and are oriented approximately perpendicularly with respect to one another. With this configuration each adjacent wall will be oriented approximately perpendicularly with respect to each adjacent interior wall with the sliding block assembly in gliding abutment with respect to those interior walls that are oppositely positioned and extend parallel with respect to one another. This configuration is achievable wherein the configuration of the mast is as a hollow rectangular member.

It should be appreciated that the mast preferably is formed as a single solid extrusion of aluminum material and that the winch is preferably powered electrically.

It is an object of the present invention to provide a rotatable boat lift which is cable of lateral rotation after removal of a boat from an adjacent water environment for positioning thereof above a pier of an environmental structure.

It is an object of the present invention to provide a rotatable boat lift which includes a vertically moveable mast to facilitate removal and replacement of a watercraft from an adjacent water environment.

It is an object of the present invention to provide a rotatable boat lift which is easily maintained.

It is an object of the present invention to provide a rotatable boat lift which requires the minimum capital cost outlay.

It is an object of the present invention to provide a rotatable boat lift which makes use of sliding pads to facilitate vertical movement of the cradle which retains a boat thereupon for lifting.

It is an object of the present invention to provide a rotatable boat lift which does not include any type of rollers for facilitating movement between a vertically reciprocating mast and the surrounding environmental structure.

It is an object of the present invention to provide a rotatable boat lift which includes a vertically reciprocating mast which holds a cradle fixedly secured to the lower portion thereof upon which vessel support members are included for facilitating supporting of the boat with respect to the lift.

It is an object of the present invention to provide a rotatable boat lift which provides an upper and lower pin member positionable within a respective upper and lower cup to facilitate lateral rotation of the boat lift head with respect to the mounting bracket once a boat is totally moved from the water environment.

It is an object of the present invention to provide a rotatable boat lift which is of lightweight construction and yet is extremely strong.

It is an object of the present invention to provide a rotatable boat lift which is resistive to the corrosive effects of adjacent water areas.

It is an object of the present invention to provide a rotatable boat lift which is a distinct improvement of wall prior art devices for achieving this purpose.

BRIEF DESCRIPTION OF THE DRAWINGS

While the invention is particularly pointed out and distinctly described herein, a preferred embodiment is set forth in the following detailed description which may be best understood when read in connection with the accompanying drawings in which.

DETAILED DESCRIPTION OF THE PREFERRED EMBODIMENT

Figure 1:
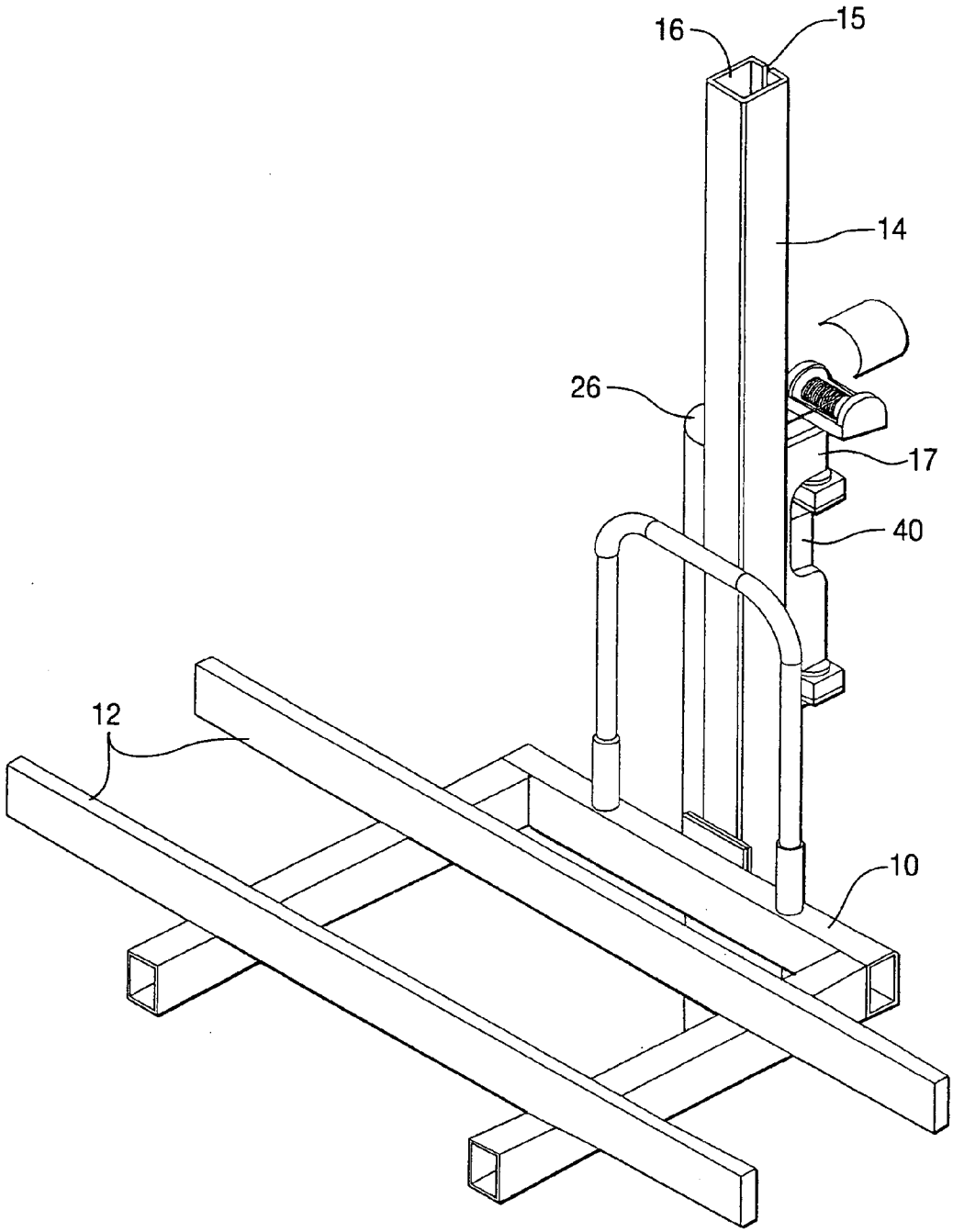
FIG. 1 is a front three-quarter perspective of an embodiment of the rotatable boat lift with sliding pads of the present invention.
Figure 2:
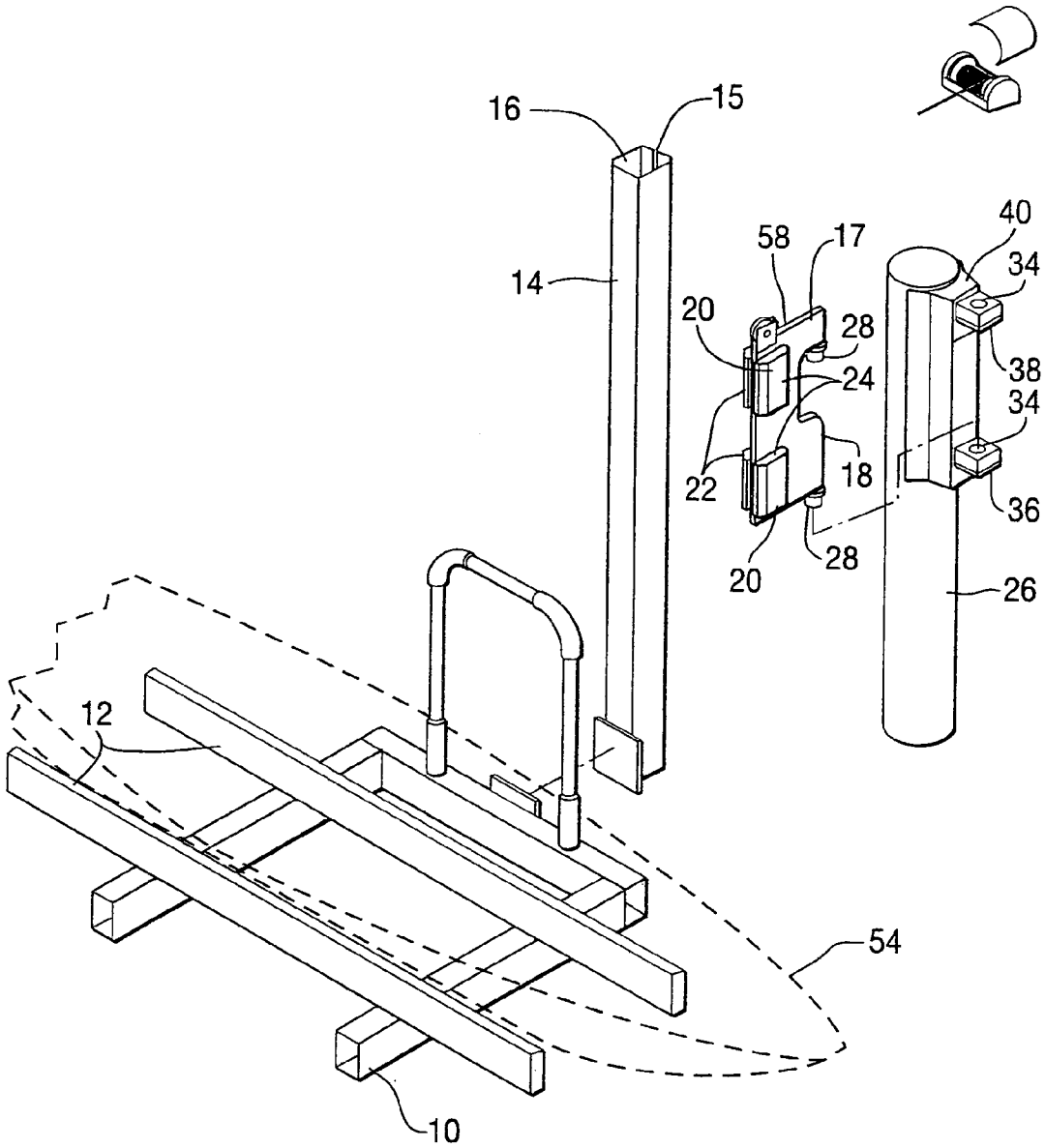
FIG. 2 is an exploded view of the embodiment of the present invention showing FIG. 1.
Figure 3:
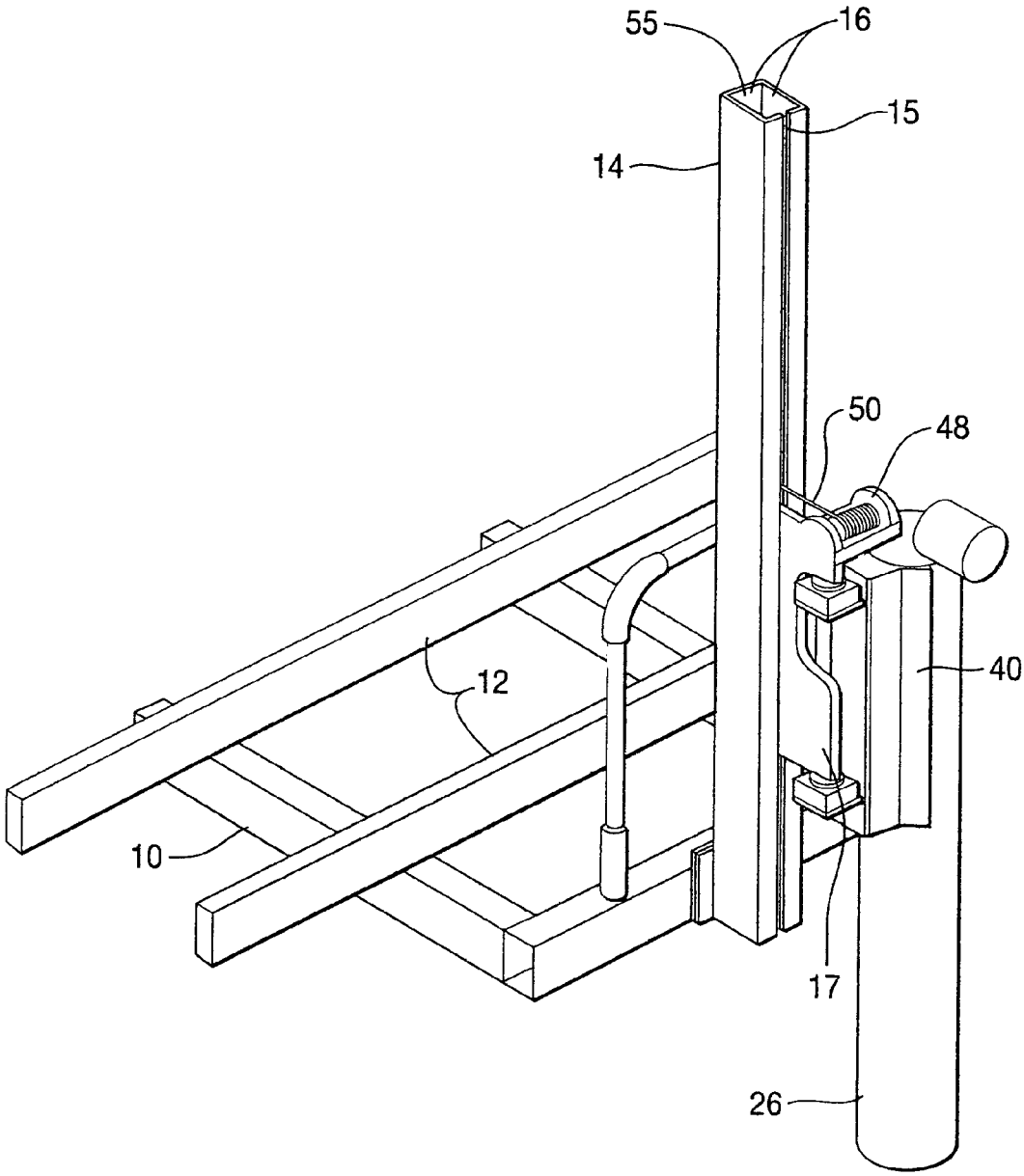
FIG. 3 is a rear perspective view of the embodiment of the present invention as shown in FIG. 1.
Figure 5:
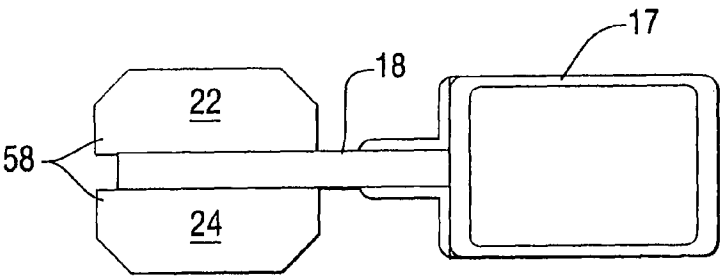
FIG. 5 is a top plan view of the embodiment of the boat lift head shown in FIG. 4.
Figure 6:
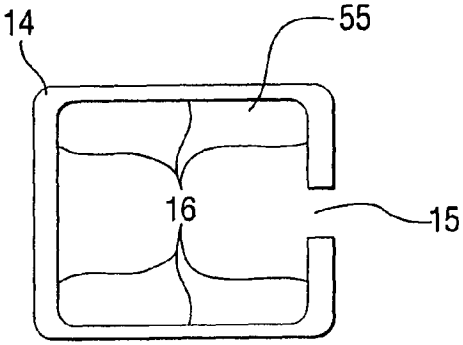
FIG. 6 is a top cross-sectional view of an embodiment of the reciprocating mast of the present invention showing the interior contact surfaces of the mast and the longitudinal extending mast slot defined therein.
Figure 4:
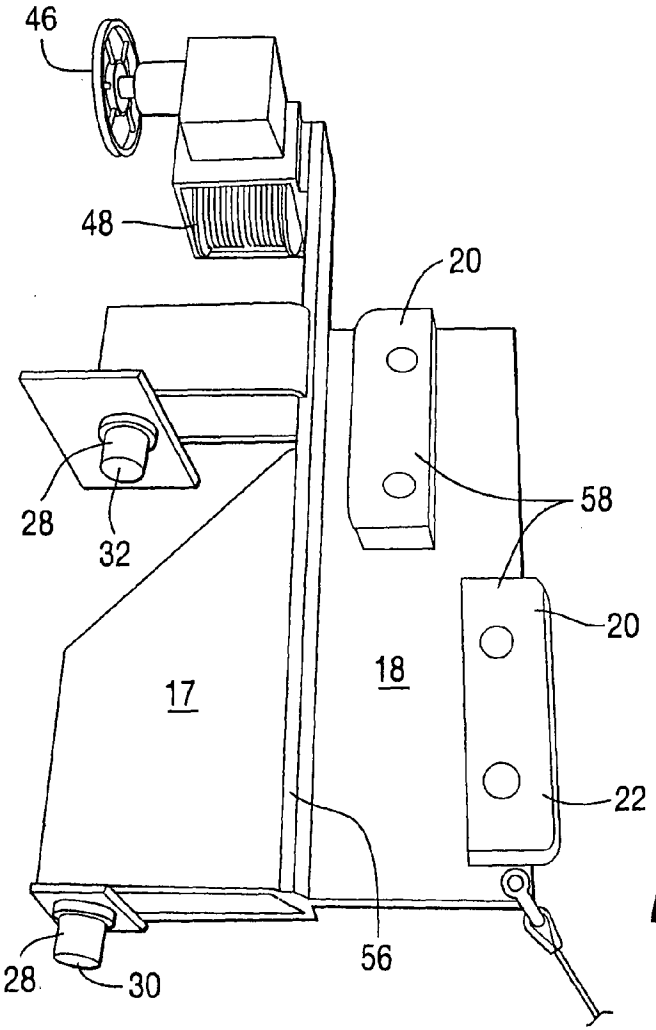
FIG. 4 is a side plan view of an embodiment of the head of the boat lift of the present invention clearly showing the upper and lower mounting pin members, the winch, the fin, the sliding wear pads and the guide plate.
Figure 8:
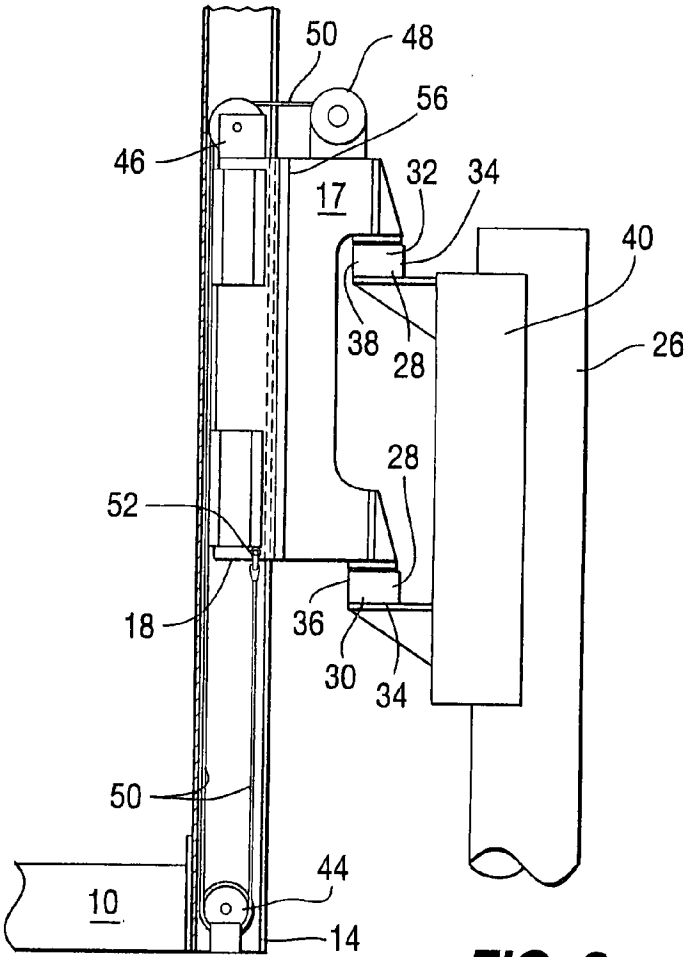
FIG. 8 is a side schematic view of an embodiment of the present invention showing the mast in the lower position.
Figure 7:
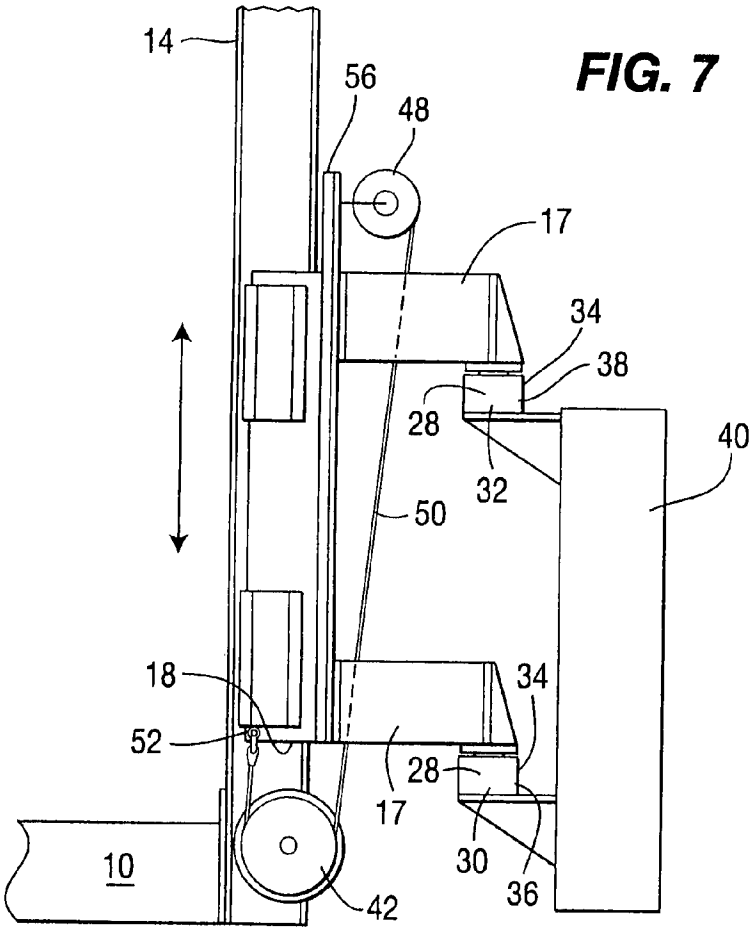
FIG. 7 is a side schematic view of an embodiment of the apparatus of the present invention showing the mast in the upper position.
Figure 9:
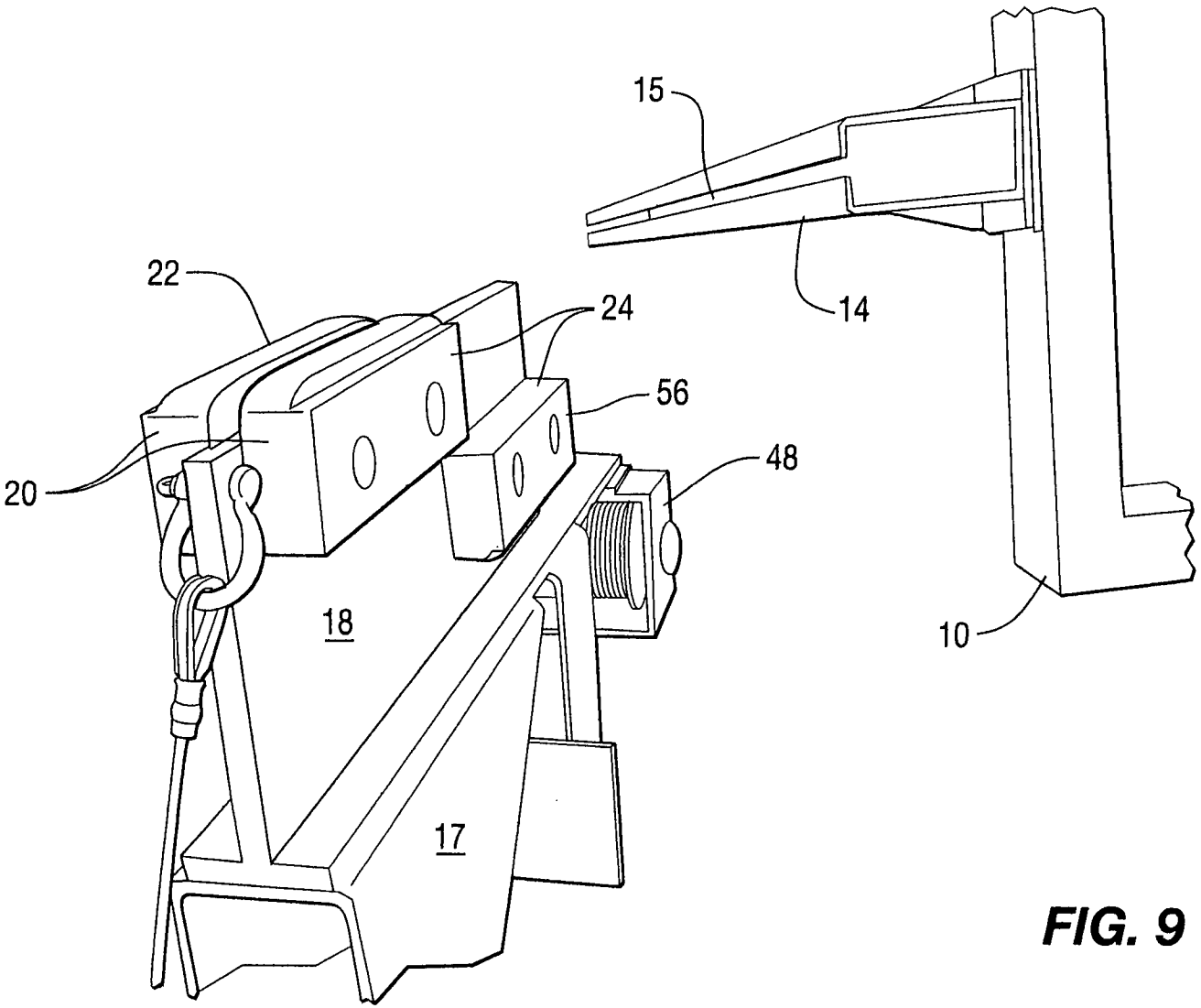
FIG. 9 is a perspective illustration from the bottom of the embodiment of the boat lift head shown in FIG. 4 showing the rotating head assembly disengaged from positioning within the slotted mast.

The present invention provides a boat lift for use adjacent to a piling or pier 26 normally positioned within a boat storage area such as a dock or similar area. The boat lift of the present invention includes a mounting bracket 40 securable to the piling 26 in such a manner as to be firmly secured thereto. A rotating head 17 is movably mounted with respect to the piling mounting bracket 40 such that it is capable of lateral rotational movement with respect thereto.

This lateral movement is achieved by providing the piling mounting bracket 40 with a cup means 34. The rotating head 17 will include a pin means 28 adapted to be positioned within the cup means 34 to provide the rotational movement capability between the rotating head 17 and the fixedly positioned bracket 40.

In the preferred configuration of the present invention, the pin means 28 will include a lower pin member 30 and an upper pin member 32. Also the cup means 34 will include a lower cup 36 and an upper cup 38. Preferably with this configuration the lower pin member 30 will be adapted to be positioned within the lower cup 36 simultaneously with positioning of the upper pin member 32 within the upper cup 38. In this manner a secure and reliable rotational capability will be provided for the rotating head 17 for pivoting with respect to the mounting bracket 40 and piling or pier 26. Rotating head 17 will preferably include a fin 18 extending outwardly therefrom. This fin 18 is adapted to extend into a mast 14. The mast 14 is preferably constructed as a longitudinally extending member preferably having a rectangular or square cross-section with a longitudinally extending mast slot 15 extending vertically therealong. The mast 14 preferably is hollow and will define a plurality of interior contact surfaces 16 therewithin.

With this configuration, the fin 18 of the rotating head 17 will include a sliding pad assembly 58 secured thereto which includes wear pads 20 such that when the fin 18 is positioned extending through the mast slot 15, the wear pads 20 will be positioned within the interior portion of the mast 14 in abutting contact with respect to the mast interior contact surfaces 16.

These wear pads 20 can be of a variety of different bearing-type materials but will preferably be of a polymer material or other similar plastic material having a low coefficient of friction to facilitate sliding movement of the mast 14 vertically with respect to the rotating head 17. It should be appreciated that the rotating head 17 is movable in a lateral direction, but in this embodiment is not designed to have any movement capability vertically whatsoever. All vertical movement to facilitate powered movement of the retaining watercraft 54 are provided by the vertical movement capability of the rotating head and watercraft retaining assembly defined herebelow.

To further facilitate stable relative vertical movement of the mast 14 relative to the head 17, preferably the wear pad means 20 will include one or more first wear pad strips 22 on one side of the fin 18, and a similar number of second wear pad strips 24 on the opposite side of the fin 18. These wear pads strips 22 and 24 will be secured to the fin 18, and will be of sufficient size to extend outwardly therefrom such that they both will simultaneously contact the interior contact surfaces 16 of mast chamber 55 of mast 14 for slideable engagement with respect thereto responsive to the fin 18 being positioned extending through mast slot 15 into the mast chamber 55. This assembly will guide controlled vertical movement of the mast 14 relative to the rotating head 17.

Mast 14 is designed to extend downwardly such that the lower portion thereof can travel below water level and will include a cradle 10 secured thereto near the lower end thereof. Cradle 10 includes vessel support members 12 extending therealong which are adapted to extend beneath a watercraft for contacting the under surface thereof to facilitate lifting of the watercraft responsive to vertical movement of the mast 14 upwardly to the storage position. Return movement downwardly will also be similarly provided. The configuration of the vessel support members 12 normally comprise two parallel longitudinally extending members as shown best in FIG. 1.

Reciprocating movement of the mast 14 relative to the head 17 is preferably powered by a winch 48. Winch 48 includes a cable 50 secured thereto and selectively extendable outwardly therefrom such that it is secured at the outer opposite end 52 to the rotating head 17, and, specifically, to the fin 18 thereof. This point of connection is often referred to in this industry as a dead man connection. The cable 50 extends around a plurality of pulleys 42 in order to power movement of the mast 14 in a reciprocating manner relative to the head 17. Preferably the pulley construction will include a lower pulley 44 attached to the mast 14, and can include an upper pulley 46 for operatively facilitating selective powering of movement of the mast 14 while carrying the watercraft upon the cradle 10 secured thereto vertically relative to the rotating head 17 and relative to the piling 26 and other environmental structure.

As such, the apparatus of the present invention provides a unique means for providing a boat lift for selective removal and replacement of a watercraft 54 from a water environment adjacent to a pier and/or piling 26 which makes use of no rollers whatsoever for controlling the vertical movement which greatly minimizes maintenance. The uniquely designed wear pads 20 of the present invention are preferably made of low friction material such as a thermoplastic material to provide this gliding interconnection without experiencing the maintenance and wear problems normally associated with the use of rollers for this purpose.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

The invention claimed is:

1. A rotatable boat lift with sliding pads comprising:

A. a mounting bracket fixedly securable to environmental structure;

B. a rotating head means pivotally secured with respect to said mounting bracket and extending outwardly therefrom, said rotating head means including:

(1) a fin means extending outwardly therefrom;

(2) a sliding pad assembly attached to said fin means and extending outwardly therefrom;

C. a mast which is hollow and extends vertically longitudinally, said mast including a plurality of interior walls defining a mast chamber means therewith, said mast defining a mast slot means extending vertically therealong wherein said mast slot means is in fluid flow communication with respect to said mast chamber means within said mast, said fin means of said rotating head means being positionable extending through said mast slot means into said mast chamber means of said mast with said sliding pad assembly positioned in gliding abutment with respect to said interior walls thereof and moveable with respect thereto in order to facilitate sliding movement of said mast with respect to said rotating head means;

D. a cradle means secured to said mast and being movable therewith, said cradle means adapted to be positionable beneath a watercraft to facilitate supporting and retaining thereof with respect to said mast to facilitate urging controlled movement thereof along with said cradle means and said mast; and E. a winch means attached with respect to said rotating head means, said winch means including a cable means attached with respect to said mast to provide powered movement of said mast with respect to said rotating head means to facilitate powered movement of a watercraft supported by said cradle means responsive to operation of said winch means.

2. A rotatable boat lift with sliding pads as defined in claim 1 further comprising a pulley assembly mounted with respect to said mast and with respect to said rotating head means and being adapted to receive said cable means wound peripherally therearound to facilitate powering of movement of said mast with respect said rotating head means.

3. A rotatable boat lift with sliding pads as defined in claim 2 wherein said pulley assembly includes:

A. an upper pulley rotatably mounted with respect to said rotating head means; and B. a lower pulley rotatably mounted with respect to said mast, said cable means of said winch means extending outwardly from said winch and around said upper pulley and then downwardly around said lower pulley and then upwardly for direct attachment to said rotating head means to facilitate powering of movement of said mast with respect to said rotating head means.

4. A rotatable boat lift with sliding pads as defined in claim 1 wherein said sliding pad assembly includes:

A. at least one first wear pad strip attached to said fin means of said rotating head means and extending outwardly therefrom into engaging abutment with respect to said interior walls of said mast within said mast chamber means thereof; and B. at least one second wear pad strip attached to said fin means of said rotating head means and extending outwardly therefrom into engaging abutment with respect to said interior walls of said mast within said mast chamber means thereof at a position on said fin means spatially disposed from said at least one first wear pad strip of said rotating head means and extending outwardly therefrom.

5. A rotatable boat lift with sliding pads as defined in claim 4 wherein said sliding pad assembly includes two said first wear pad strips spatially disposed vertically from another and two said second wear pad strips spatially disposed vertically from another.

6. A rotatable boat lift with sliding pads as defined in claim 1 wherein said first and second wear pad strips are made of a thermoplastic polymer material.

7. A rotatable boat lift with sliding pads as defined in claim 1 wherein said rotating head means includes a pivot pin means and wherein said mounting bracket defines a pivot cup means adapted to receive said pivot pin means extending therein to facilitate pivotal movement of said rotating head means with respect to said mounting bracket.

8. A rotatable boat lift with sliding pads as defined in claim 7 wherein said pivot pin means includes a first pivot pin and a second pivot pin spatially disposed from one another and wherein said pivot cup means includes a first pivot cup adapted to receive said first pivot pin extending therein and wherein said pivot cup means further includes a second pivot cup adapted to receive said second pivot pin extending therein to facilitate pivotal movement of said rotating head means with respect to said mounting bracket.

9. A rotatable boat lift with sliding pads as defined in claim 8 wherein said first pivot pin and said second pivot pin are vertically registered with respect to one another and wherein said first pivot cup and said second pivot cup are also vertically registered with respect to one another.

10. A rotatable boat lift with sliding pads as defined in claim 7 wherein said rotating head means includes a guide plate thereon extending laterally with respect to said mast slot means responsive to said sliding pad assembly being positioned within said mast chamber means, said guide plate being wider than the width of said mast slot means to limit the depth of penetration of said rotating head means into said mast chamber means, said guide plate being positioned on said fin of said rotating head means between said sliding pad assembly and said pivot pin means.

11. A rotatable boat lift with sliding pads as defined in claim 1 wherein said mast chamber means is rectangular in cross-section.

12. A rotatable boat lift with sliding pads as defined in claim 1 wherein there are four interior walls within said mast which define said mast chamber means therein with each adjacent wall oriented perpendicularly with respect each adjacent said interior wall with said sliding pad assembly in gliding abutment with respect to those of said interior walls that are oppositely positioned and extend parallel with respect to one another.

13. A rotatable boat lift with sliding pads as defined in claim 1 wherein said mast slot means is defined extending longitudinally by said mast within one of said interior walls thereof.

14. A rotatable boat lift with sliding pads as defined in claim 1 further comprising a vessel support secured to said cradle means and extending upwardly therefrom to facilitate support and retaining of a watercraft with respect thereto.

15. A rotatable boat lift with sliding pads as defined in claim 14 wherein said vessel support includes two vessel support members spatially disposed with respect to one another to facilitate supporting of a watercraft by said cradle means.

16. A rotatable boat lift with sliding pads as defined in claim 1 wherein said rotating head means is movable with respect to said mounting bracket through an arc of at least ninety degrees.

17. A rotatable boat lift with sliding pads as defined in claim 1 wherein said mast is formed as a solid aluminum extrusion.

18. A rotatable boat lift with sliding pads as defined in claim 1 wherein said winch means is electrically powered.

19. A rotatable boat lift with sliding pads comprising:

A. a mounting bracket fixedly securable to environmental structure;

B. a rotating head means pivotally secured with respect to said mounting bracket to be movable through an angle of at least ninety degrees and extending outwardly therefrom, said rotating head means including:

(1) a fin means extending outwardly therefrom;

(2) a sliding pad assembly attached to said fin means and extending outwardly therefrom;

C. a mast which is hollow and extends vertically longitudinally, said mast including a plurality of interior walls defining a mast chamber means therewith, one of said interior walls of said mast defining a mast slot means extending vertically therealong, said mast slot means being in fluid flow communication with respect to said mast chamber means within said mast, said fin means of said rotating head means being positionable extending through said mast slot means into said mast chamber means of said mast with said sliding pad assembly positioned in gliding abutment with respect to said interior walls thereof and moveable with respect thereto in order to facilitate sliding movement of said mast with respect to said rotating head means;

D. a cradle means secured to said mast and being movable therewith, said cradle means adapted to be positionable beneath a watercraft to facilitate supporting and retaining thereof with respect to said mast to facilitate urging controlled movement thereof along with said cradle means and said mast, said cradle means further including a vessel support secured thereto and extending upwardly therefrom to facilitate support and retaining of a watercraft with respect thereto, said vessel support including two vessel support members spatially disposed with respect to one another to facilitate supporting of a watercraft by said cradle means;

E. a winch means attached with respect to said rotating head means, said winch means including a cable means attached with respect to said mast to provide powered movement of said mast with respect to said rotating head means to facilitate powered movement of a watercraft supported by said cradle means responsive to operation of said winch means; and F. a pulley assembly mounted with respect to said mast and with respect to said rotating head means and being adapted to receive said cable means wound peripherally therearound to facilitate powering of movement of said mast with respect said rotating head means.

20. A rotatable boat lift with sliding pads comprising:

A. a mounting bracket fixedly securable to environmental structure, said mounting bracket defines a pivot cup means therein;

B. a rotating head means pivotally secured with respect to said mounting bracket to be movable through an angle of at least ninety degrees and extending outwardly therefrom, said rotating head means including:

(1) a fin means extending outwardly therefrom;

(2) a sliding pad assembly attached to said fin means and extending outwardly therefrom, said sliding pad assembly includes:

(a) at least one first wear pad strip of thermoplastic polymer material attached to said fin means of said rotating head means and extending outwardly therefrom; and (b) at least one second wear pad strip of thermoplastic polymer material attached to said fin means of said rotating head means and extending outwardly therefrom at a position spatially disposed from said first wear pad strip;

(3) a pivot pin means extending downwardly therefrom which is adapted to extend into said pivot cup means defined in said mounting bracket to facilitate pivotal movement of said rotating head means with respect to said mounting bracket;

(4) a guide plate extending outwardly from said fin means, extending laterally with respect to said mast slot means responsive to said sliding pad assembly being positioned within said mast chamber means;

C. a mast which is hollow and extends vertically longitudinally, said mast including a plurality of interior walls defining a mast chamber means therewith which is generally rectangular in cross-sectional shape, one of said interior walls of said mast defining a mast slot means extending vertically therealong, said mast slot means being in fluid flow communication with respect to said mast chamber means within said mast, said fin means of said rotating head means being positionable extending through said mast slot means into said mast chamber means of said mast with said sliding pad assembly positioned in gliding abutment with respect to said interior walls thereof and moveable with respect thereto in order to facilitate sliding movement of said mast with respect to said rotating head means, said first wear pad strip and said second wear pad strip extending outwardly from said rotating head means into engaging moveable abutment with respect to said interior walls of said mast within said mast chamber means thereof to facilitate movement of said mast with respect to said rotating head means, said guide plate positioned on said rotating head means extending laterally with respect to said mast slot means responsive to said sliding pad assembly being positioned within said mast chamber means, said guide plate being wider than the width of said mast slot means to limit the depth of penetration of said rotating head means into said mast chamber means, said guide plate being positioned on said fin of said rotating head means between said sliding pad assembly and said pivot pin means;

D. a cradle means secured to said mast and being movable therewith, said cradle means adapted to be positionable beneath a watercraft to facilitate supporting and retaining thereof with respect to said mast to facilitate urging controlled movement thereof along with said cradle means and said mast, said cradle means further including a vessel support secured thereto and extending upwardly therefrom to facilitate support and retaining of a watercraft with respect thereto, said vessel support including two vessel support members spatially disposed with respect to one another to facilitate supporting of a watercraft by said cradle means;

E. a winch means attached with respect to said rotating head means, said winch means including a cable means attached with respect to said mast to provide powered movement of said mast with respect to said rotating head means to facilitate powered movement of a watercraft supported by said cradle means responsive to operation of said winch means;

F. a pulley assembly mounted with respect to said mast and with respect to said rotating head means and being adapted to receive said cable means wound peripherally therearound to facilitate powering of movement of said mast with respect said rotating head means, said pulley assembly including:

(1) an upper pulley rotatably mounted with respect to said rotating head means; and (2) a lower pulley rotatably mounted with respect to said mast, said cable means of said winch means extending outwardly from said winch and around said upper pulley and then downwardly around said lower pulley and then upwardly for direct attachment to said rotating head means to facilitate powering of movement of said mast with respect to said rotating head means.

* * * * *